US008327746B2

(12) United States Patent
Behrmann et al.

(10) Patent No.: US 8,327,746 B2
(45) Date of Patent: Dec. 11, 2012

(54) WELLBORE PERFORATING DEVICES

(75) Inventors: Lawrence A. Behrmann, Houston, TX (US); Francois Black, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 208 days.

(21) Appl. No.: 12/761,459

(22) Filed: Apr. 16, 2010

(65) Prior Publication Data

US 2010/0269676 A1 Oct. 28, 2010

Related U.S. Application Data

(60) Provisional application No. 61/171,570, filed on Apr. 22, 2009.

(51) Int. Cl.
*E21B 43/117* (2006.01)

(52) U.S. Cl. ..... 89/1.15; 102/305; 102/208; 102/310

(58) Field of Classification Search ..... 89/1.15; 175/4.55–4.6; 166/297; 102/305–310
See application file for complete search history.

(56) References Cited

U.S. PATENT DOCUMENTS

| | | | | |
|---|---|---|---|---|
| 3,040,659 | A | 6/1962 | McCullough | |
| 3,154,147 | A | 10/1964 | Lanmon, II | |
| 3,242,987 | A * | 3/1966 | Lebourg | 166/297 |
| 4,391,337 | A * | 7/1983 | Ford et al. | 175/4.6 |
| 4,496,009 | A * | 1/1985 | DerMott et al. | 175/4.52 |
| 4,726,431 | A * | 2/1988 | Oestreich et al. | 175/4.6 |
| 4,844,170 | A * | 7/1989 | Gill | 166/297 |
| 4,960,171 | A * | 10/1990 | Parrott et al. | 166/55 |
| 5,054,564 | A * | 10/1991 | Oestreich et al. | 175/4.6 |
| 5,392,857 | A | 2/1995 | Behrmann | |
| 5,785,130 | A * | 7/1998 | Wesson et al. | 175/4.6 |
| 6,397,947 | B1 | 6/2002 | Behrmann et al. | |
| 7,172,023 | B2 * | 2/2007 | Barker et al. | 166/297 |
| 7,303,017 | B2 * | 12/2007 | Barker et al. | 166/297 |
| 7,409,992 | B2 * | 8/2008 | Zazovsky et al. | 166/297 |
| 7,913,758 | B2 * | 3/2011 | Wheller et al. | 166/259 |
| 2002/0185275 | A1 * | 12/2002 | Yang et al. | 166/297 |
| 2003/0102162 | A1 | 6/2003 | Sloan et al. | |
| 2005/0194146 | A1 | 9/2005 | Barker et al. | |
| 2006/0118303 | A1 * | 6/2006 | Schultz et al. | 166/297 |
| 2007/0158109 | A1 | 7/2007 | Zazovsky et al. | |
| 2011/0042089 | A1 * | 2/2011 | Chang et al. | 166/297 |

* cited by examiner

*Primary Examiner* — Michael David
(74) *Attorney, Agent, or Firm* — Rodney Warfford; Jody Lynn DeStefanis; Bud Ehrlich

(57) ABSTRACT

Wellbore perforating devices are disclosed. In one example, a wellbore perforating device includes a plurality of shaped charges and a holder that holds the plurality of shaped charges so that upon detonation the charges intersect a common plane extending transversely to the holder.

7 Claims, 6 Drawing Sheets

WELLBORE PERFORATING DEVICES

CROSS REFERENCE TO RELATED APPLICATION

The present application relates to and claims priority of U.S. Provisional Patent Application No. 61/171,570, filed Apr. 22, 2009, which is fully incorporated herein by reference.

BACKGROUND

To enhance production from a subterranean formation, a perforating gun is lowered into a wellbore extending through the formation. Radially oriented shaped charges on the perforating gun are detonated to perforate the surrounding well casing and formation to enhance or facilitate the initiation and propagation of transverse-to-wellbore fractures. U.S. Pat. Nos. 5,392,857 and 6,397,947 disclose apparatuses and methods for optimizing designs of a perforating gun, including methods for optimizing phase angles of shaped charges in perforating guns. The disclosures of these patents are fully incorporated herein by reference.

SUMMARY

The present application discloses devices for wellbore perforating, and more specifically discloses perforating devices for optimizing downhole transverse fracturing to thereby maximize reservoir contact. In one example, a wellbore perforating device includes a plurality of shaped charges that are held by a holder so that upon detonation of the charges, charge jets intersect a common plane extending transversely to the holder at a predetermined radial distance from the wellbore. The holder is generally elongated in a longitudinal direction along which the shaped charges are spaced apart. The plurality of shaped charges can include for example at least three charges, including a pair of outer charges and an inner charge disposed between the pair of outer charges in the longitudinal direction. The outer charges are tilted towards the inner charge with respect to the longitudinal direction. In this example, the inner charge is held by the holder at a generally perpendicular orientation relative to the longitudinal direction, such that upon detonation, the inner charge forms a jet that travels outwardly from the holder in a radial direction that is substantially perpendicular to the longitudinal direction and that extends along the common plane. Upon detonation, the outer charges travel at an angle to the radial direction and so as to intersect with the common plane at the predetermined radial distance.

In some examples, the outer charges are also azimuthally phased at a non-zero angle to the inner charge with respect to the longitudinal direction. The outer charges can be azimuthally phased, for example within 15° of the inner charge, within 30° of the inner charge, within 120° of the inner charge, etc. Optionally, the outer charges also can be azimuthally phased with respect to each other in the longitudinal direction.

In other examples, a wellbore perforating device includes first and second gun sections that are connected together in series. Each gun section includes a holder that holds a respective plurality of shaped charges. Upon detonation, each charge in a respective plurality of shaped charges forms a jet that intersects a common plane extending transversely to the wellbore at a predetermined radial distance from the wellbore. The holders in each of the first and second gun sections can be arranged such that upon detonation, jets of each respective plurality of shaped charges intersect a common plane at a predetermined radial distance from the wellbore.

Further examples and alternatives are described herein below.

BRIEF DESCRIPTION OF THE DRAWINGS

The best mode is described herein below with reference to the following drawing figures.

DETAILED DESCRIPTION OF THE DRAWINGS

Figure 1:
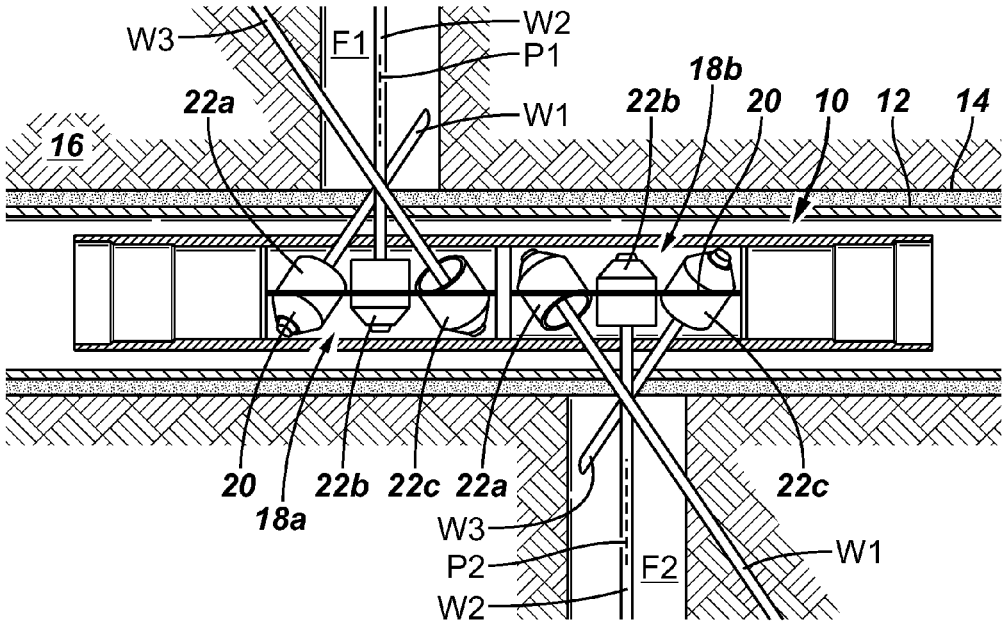
FIG. 1 depicts one example of a wellbore perforating device disposed in a horizontal well that extends into a subterranean formation.

In the following description, certain terms have been used for clearness and understanding. No unnecessary limitations are to be implied therefrom beyond the requirement of prior art because such terms are used for descriptive purposes and are intended to be broadly construed. The different devices and methods described herein may be used alone or in combination with other devices and methods. It is to be expected that various equivalents, alternatives, and modifications are possible within the scope of the appended claims. For example, although FIG. 1 depicts a cased horizontal wellbore, the perforating devices disclosed herein can be used in cased or uncased vertical or other non-horizontal wellbores and in a variety of underground formations. Although the Figures depict certain types and sizes of shaped charges, the present disclosure contemplates that different sizes and different types of charges could be used alone or in combination with other sizes and types of charges. Further, although the Figures depict holders that hold the charges at certain angles with respect to each other and with respect to the length of the holder, the present disclosure contemplates that the charges could be held by different holder configurations and at different angles with respect to each other and with respect to the holder. Although the Figures depict certain numbers of charges and numbers of perforating gun sections, the present disclosure contemplates that more or fewer charges and perforating gun sections could be used. Further variations of the structures depicted and described herein are contemplated within the scope of the present disclosure and within the scope of the appended claims.

As used herein, the terms "above" and "below"; "up" and "down"; "upper" and "lower"; "upwardly" and "downwardly"; and other like terms indicating relative positions above or below a given point or element are used in this description to more clearly describe some examples. However, when applied to equipment and methods for use in wells that are deviated from vertical or horizontal, such terms may refer to a left to right, right to left, or diagonal relationship, as appropriate.

FIG. 1 depicts a perforating gun 10 disposed in a casing 12 of a horizontal wellbore 14 extending through an underground formation 16. The gun 10 is depicted in isolation, but as will be understood by one or ordinary skill in the art, typically will be connected to known varieties of production equipment, such as coiled tubing conveyances or the like, for selectively positioning perforating devices in wellbores. The gun 10 includes a plurality of sections 18*a*, 18*b*, etc. Each section 18*a*, 18*b* includes a holder 20 for holding a plurality of shaped charges 22*a*, 22*b*, 22*c* for detonation. The number of sections and the number of shaped charges in each section can vary from that depicted. As will be described further herein below, upon detonation the charges 22*a*, 22*b*, 22*c* in each section 18*a*, 18*b* form jets that are projected from the holder 20 and travel along a predetermined pathway W1, W2, W3, respectively, so as to intersect a common plane P extending transversely from the holder 20 at a predetermined radial distance from the wellbore, and to thereby enhance the initiation and formation of either a transverse fracture F or a pseudo tilted longitudinal-to-transverse fracture through the casing 12 and into the formation 16 from the wellbore 14. Examples having multiple sections 18*a*, 18*b*, etc. can be configured to form jets that intersect different planes P1, P2, etc. to form multiple transverse fractures F1, F2, (for example, extending fractures both up and down in a horizontal wellbore) etc.

Figure 2:
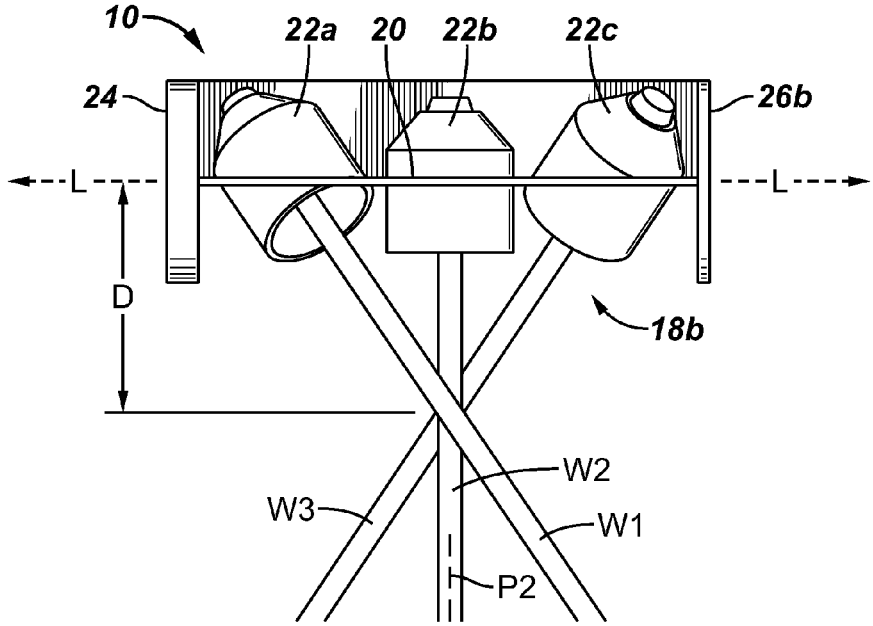
FIG. 2 is a side view of a section of a wellbore perforating device.

FIG. 2 depicts one exemplary section 18*b* of the gun 10. The section 18*b* includes a holder 20 that holds a plurality of shaped charges 22*a*, 22*b*, 22*c*. The holder 20 is elongated in a longitudinal direction L and includes a plate-like member having cavities for holding the plurality of charges 22*a*, 22*b*, 22*c* in a spaced apart orientation along the longitudinal direction L. Other non-plate-like configurations of the holder 20 are possible with the scope of this disclosure. The plurality of charges 22*a*, 22*b*, 22*c*, includes a pair of outer charges 22*a*, 22*c* and an inner charge 22*b* disposed between the pair of outer charges 22*a*, 22*c* in the longitudinal direction L. Each outer charge 22*a*, 22*c* is tilted towards the inner charge 22*b* with respect to the longitudinal direction L. This is more clearly depicted in the section view of the example of FIG. 4 by tilt angle T.

Figure 4:
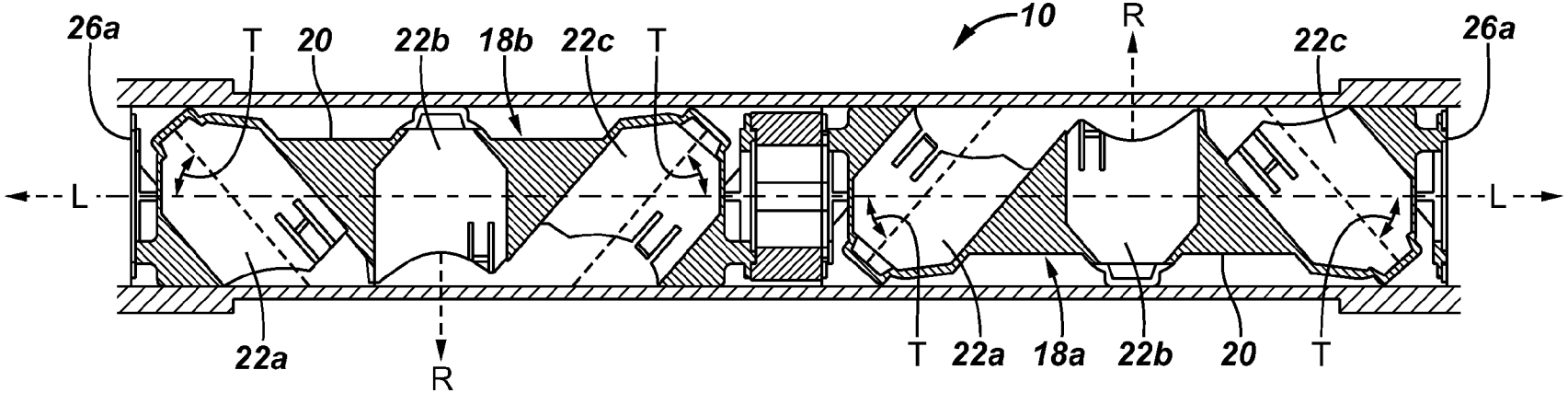
FIG. 4 is a sectional view of two sections of a wellbore perforating device.

As shown in FIGS. 2 and 4, the inner charge 22*b* is held by the holder 20 at a generally perpendicular orientation to the longitudinal direction L such that upon detonation, the inner charge 22*b* forms a jet that is propelled generally perpendicularly to the holder 20 in a radial direction R and along plane P2 extending perpendicularly to the holder 20. This is more clearly depicted in the perspective view of FIG. 2 by W2 and in the sectional view of FIG. 4 by R. The outer charges 22*a*, 22*c* are tilted towards the inner charge 22*b* at tilt angle T and thus upon detonation form jets that travel towards and intersect with the plane P2. Thus upon detonation, each of the charges 22*a*, 22*b*, 22*c* form a jet that intersects the common plane P2 extending transversely to the holder 20 at a predetermined radial distance D from the wellbore 14. The angle of tilt T of the outer charges 22*a*, 22*c* can vary and can be specifically selected to achieve an intersection by the jets of the outer charges 22*a*, 22*b* with the plane P2 at a predetermined radial distance D from the wellbore 14. For example, in some circumstances, the present inventors found it to be advantageous for the jets of the outer charges 22*a*, 22*c* to intersect the common plane P2 at the location where a sand face exists surrounding the wellbore casing 12. In another example, the jets of the charges 22*a*, 22*b*, 22*c* could intersect the common plane P2 at a distance between the sand face and one wellbore diameter. By selecting an appropriate angle of tilt T of the outer charges 22*a*, 22*c*, this radial intersection location with plane P2 can advantageously be achieved. Although the drawing figures depict a perpendicular orientation for inner charge 22*b*, the orientation of the inner charge 22*b* does not necessarily have to be perpendicular to the holder 20. As understood from the comments above, the various tilt angles of each of the charges 22*a*, 22*b*, 22*c* can be varied to achieve different objectives depending upon the well environment and particular fracturing objectives.

Figure 5:
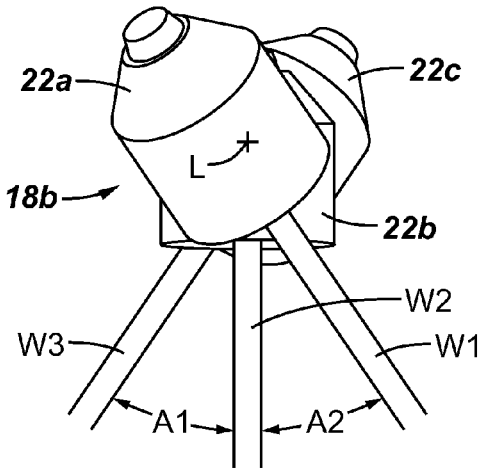
FIG. 5 is an end view of a plurality of shaped charges.

FIG. 5 is an end view of a section 18*b* of a plurality of charges and further depicts the phasing of the charges 22*a*, 22*b*, 22*c* with respect to each other at azimuth angles, e.g., A1, A2. Such phasing is an optional feature and the angle of phasing can vary and be specifically selected to achieve a desirable path of travel of the jets formed by charges 22*a*, 22*b*, 22*c*. In the example shown, the charges 22*a*, 22*b*, 22*c* are phased about the longitudinal direction L by azimuth angles A1, A2. While the charges 22*a*, 22*b*, 22*c* are held in the phased relationship defined by the holder 20 (FIG. 2), the azimuth angles A1, A2 are more readily identifiable by a comparison of the projection jet pathways W1, W2, W3, as depicted in FIG. 5. In some examples, the outer charges 22*a*, 22*c* are azimuthally phased within 15 degrees of the inner charge 22*b*. In other examples, the outer charges 22*a*, 22*c*, are azimuthally phased within 30 degrees of the inner charge 22*b*. In other examples, the outer charges 22*a*, 22*c* are azimuthally phased within 120 degrees of the inner charge 22*b*. Phasing of shaped charges is described in more particularity in U.S. Pat. Nos. 5,392,857 and 6,397,947, which are incorporated herein by reference.

Figure 3:
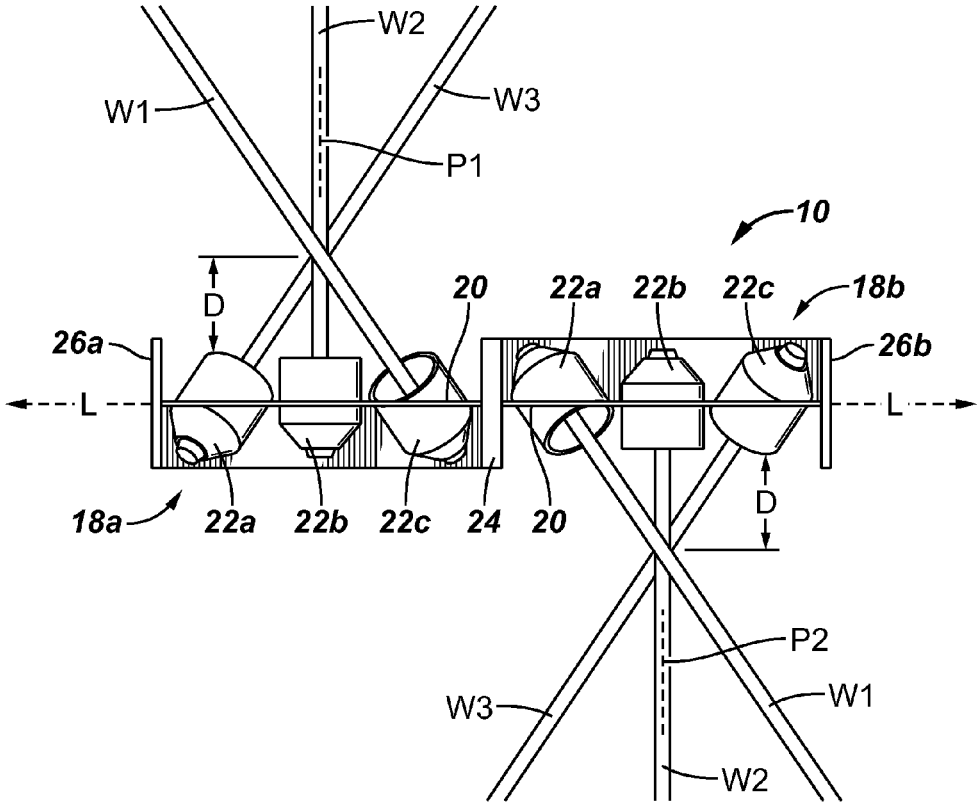
FIG. 3 is a side view of two sections of a wellbore perforating device.

FIGS. 1, 3 and 4 depict presently preferred examples of a gun 10 having first and second sections 18*a*, 18*b* connected together in series. Specifically, each gun section 18*a*, 18*b* includes a holder 20 that holds a respective plurality of shaped charges 22*a*, 22*b*, 22*c* such that upon detonation of each plurality of shaped charges 22*a*, 22*b*, 22*c*, the predetermined jet pathway W1, W2, W3 of each charge in a respective plurality intersects a common plane, i.e. P1 or P2, extending transversely to the wellbore 14 at a predetermined radial distance D. The holders 20 in the first and second gun sections 18*a*, 18*b* are arranged such that upon detonation the predetermined jet pathways W1, W2, W3 of each respective plurality of shaped charges 22*a*, 22*b*, 22*c* intersect a different common plane P1 or P2. As with the example depicted in FIG. 2, each plurality of shaped charges 22*a*, 22*b*, 22*c* depicted in FIGS. 1, 3 and 4 comprises a pair of outer charges 22*a*, 22*c* and an inner charge 22*b* disposed between the pair of outer charges 22*a*, 22*c* in the longitudinal direction L. The inner charge 22*b* is preferably held by the holder 20 at a generally perpendicular orientation to the longitudinal direction L such that upon detonation the jet of the inner charge 22*b* travels outwardly from the holder 20 in a radial direction R that is substantially perpendicular to the longitudinal direction L.

In the examples of FIGS. 1, 3 and 4, each gun section 18*a*, 18*b* containing a plurality of shaped charges 22*a*, 22*b*, 22*c* can be azimuthally aligned or azimuthally phased with respect to other gun sections in the perforating gun 10. In the examples of FIGS. 1, 3, and 4, the first and second gun sections 18*a*, 18*b* are azimuthally phased at an angle of 180 degrees, such that the jet of the inner charge 22*b* in the first gun section 18*a* travels in the radial direction R that is azimuthally angled at 180 degrees with respect to the direction of travel of the jet of the inner charge 22*b* in the second gun section 18*b*. The azimuth angle between gun sections can vary and can be preselected to achieve predetermined directions of travel for each jet of the plurality of shaped charges 22*a*, 22*b*, 22*c*. As in the examples described above, each outer charge 22*a*, 22*c* is tilted towards the inner charge 22*b* in the longitudinal direction, by a tilt angle T. Again, the tilt angle T can vary and be preselected to achieve performance objectives.

Phasing of the gun sections 18*a*, 18*b* at an angle with respect to the azimuth can have advantages in certain situations. For example, evenly phasing a series of gun sections, for example a series of six gun sections phased at 60 degree intervals, respectively, provides a perforating gun that does not require special orientation in the wellbore. That is, transverse fractures at 60 degree intervals circumferentially around the wellbore will be achieved regardless of the rotational position of the gun 10 disposed in the wellbore 14. Alternate phasing, for example at a series of four gun sections phased at 90 degree intervals or a series of three gun sections phased at 120 degree intervals can be employed to achieve similar results wherein the perforating gun does not require special rotational orientation in the wellbore. This allows for non-oriented transverse fracturing at selected circumferential locations of the wellbore.

Figure 6:
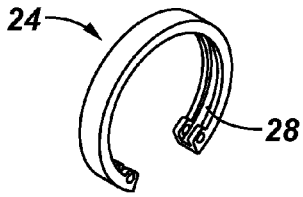
FIG. 6 is a front perspective view of a clip for connecting sections of a wellbore perforating device.

FIGS. 2, 3 and 6 also depict a clip 24 for connecting two adjacent gun sections 18*a*, 18*b*. Each gun section 18*a*, 18*b* includes opposing end flanges 26*a*, 26*b* configured to mate with a flange of an adjacent gun section. Each flange has at least one of a male or female part (not shown) for connecting with at least one of a corresponding male or female part on an adjacent flange. The clip 24 is configured to engage the opposing end flanges 26*a*, 26*b* to secure connection therebetween. In the example depicted, the clip 24 is C-shaped and includes an inner channel 28 sized to fit around the end flanges 26*a*, 26*b* when joined together. In a preferred example, more than one male or female parts on the end flanges 26*a*, 26*b* are circumferentially spaced apart from each other around the respective end flange so as to allow for selective rotational positioning of the gun section 18*a*, 18*b* at predetermined angles of rotation with respect to an adjacent gun section. This allows for easier selection of the above noted azimuth angle between the adjacent gun sections 18*a*, 18*b*. Other structural equivalents could be employed to achieve this selectivity.

Figure 7:
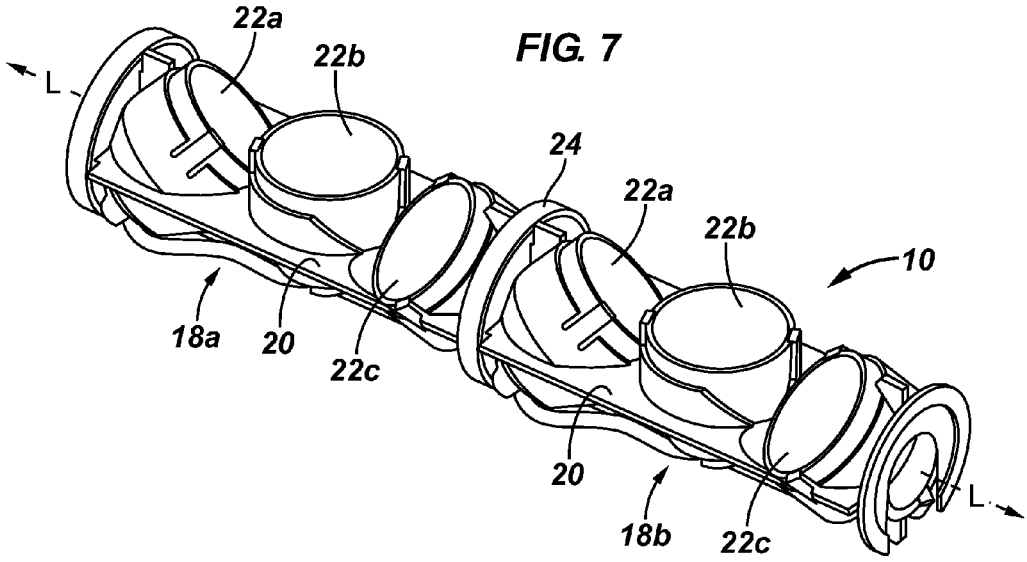
FIG. 7 is a front perspective view a wellbore perforating device.

FIG. 7 depicts another example of a wellbore perforating device or gun 10. This particular example includes two gun sections 18*a*, 18*b* that are azimuthally aligned such that the respective inner shaped charges 22*b*, when detonated, propel a jet at a substantially similar azimuth angle with respect to the holder 20. The outer charges 22*a*, 22*c* in each section 18*a*, 18*b* are azimuthally phased within 35 degrees of the inner charge 22*b*. In this example, the charges in each section 18*a* and 18*b* are similarly oriented about the azimuth such that the perforating gun will likely require rotational positioning in the wellbore to achieve fracturing at a predetermined rotational location from the wellbore. This is contrary to the examples discussed above that allow for non-oriented gun placement in the wellbore.

Figure 8:
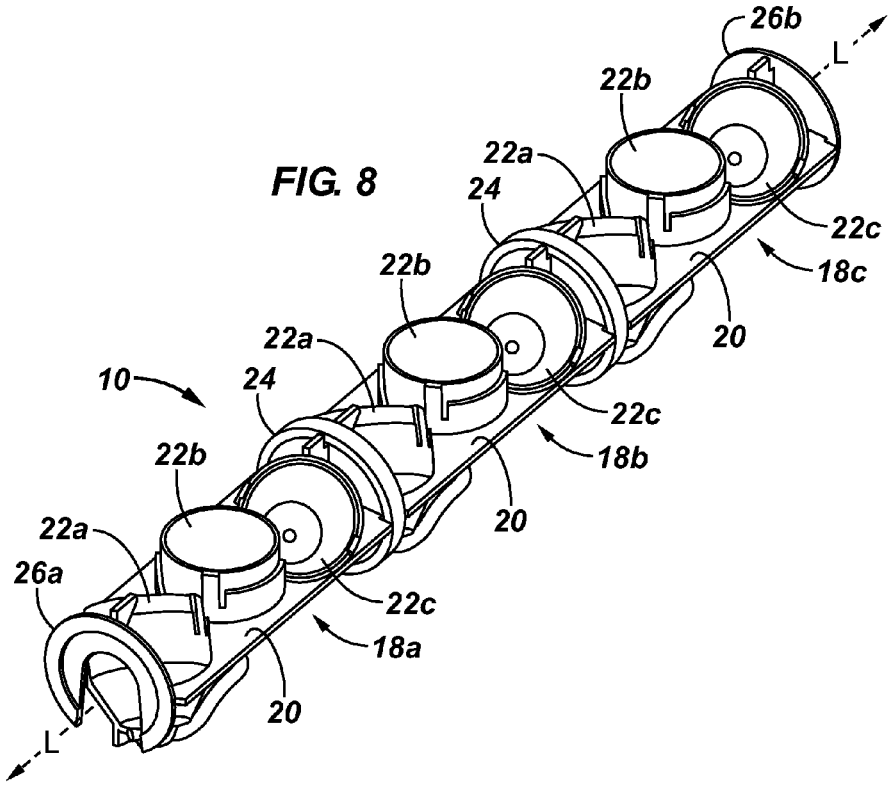
FIG. 8 is a perspective view of a wellbore perforating device.

FIG. 8 depicts another example of a perforating device or gun 10. This example includes three sections 18*a*, 18*b*, 18*c*, each having three shaped charges 22*a*, 22*b*, 22*c*. As with the example depicted in FIG. 7, each section 18*a*, 18*b*, 18*c* is azimuthally aligned. The outer charges 22*a*, 22*c* in each section are phased at an azimuth angle with respect to the respective inner charges 22*b*. Each outer charge 22*a*, 22*c* is tilted towards the respective inner charge 22*b*.

Figure 9:
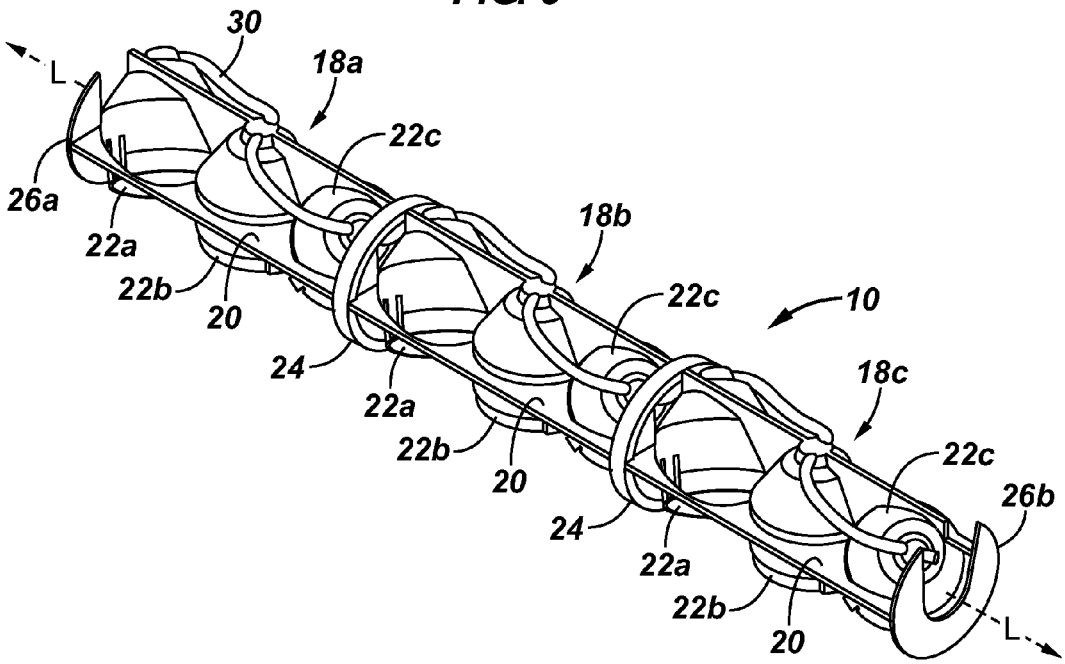
FIG. 9 is a rear perspective view of the example depicted in FIG. 8.

FIG. 9 depicts a rear view of the device 10 depicted in FIG. 8. A detonation cord 30 is connected to each shaped charge 22*a*, 22*b*, 22*c* to facilitate detonation thereof. As is conventional, the detonation chord 30 is connected to a detonator (not shown) for causing detonation of the charges 22*a*, 22*b*, 22*c*.

Figure 10:
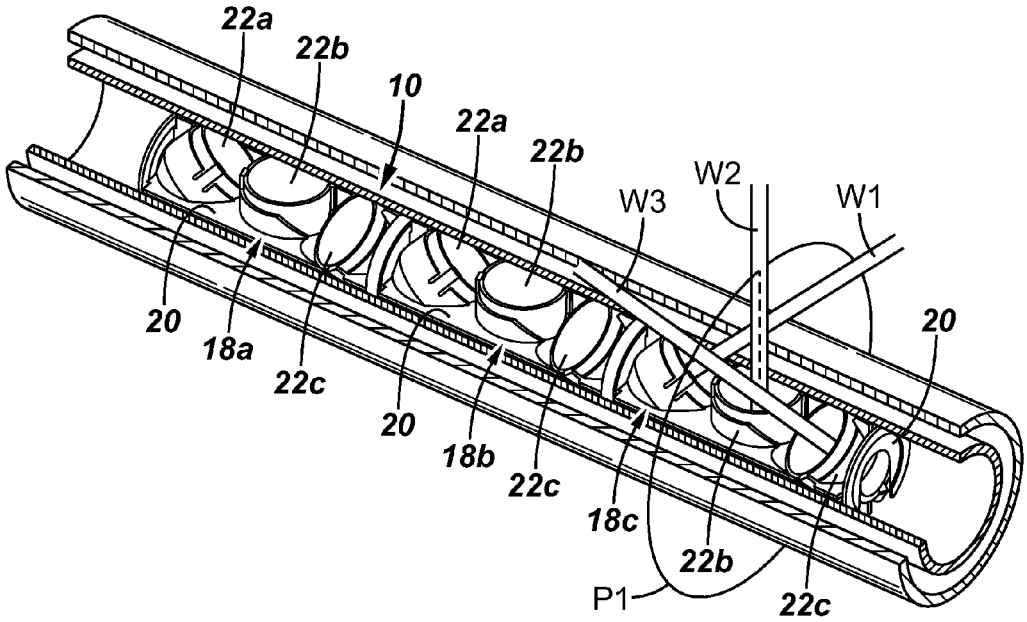
FIG. 10 is a front perspective view of a wellbore perforating device disposed in a well casing.

FIG. 10 depicts another example of a perforating device or gun 10. This example includes three sections 18*a*, 18*b*, 18*c*, each having shaped charges 22*a*, 22*b*, 22*c*. As depicted with reference to the Section 18*c*, each of the outer charges 22*a*, 22*c* is tilted towards the inner charge 22 with respect to the longitudinal direction L. Upon detonation, the jet of the inner charge 22*b* travels outwardly from the holder 20 in a radial pathway W2 that is substantially perpendicular to the longitudinal direction L and that extends along a plane P1. The jets of the outer charges 22*a*, 22*c* travel outwardly from the holder 20 respectively along pathways W1 and W3 which are angled to the radial pathway W2 so as to intersect with the common plane P1 at a predetermined radial distance to the wellbore. The outer charges 22*a*, 22*c* are also phased at an aziumuth angle with respect to the longitudinal direction L.

Figure 11:
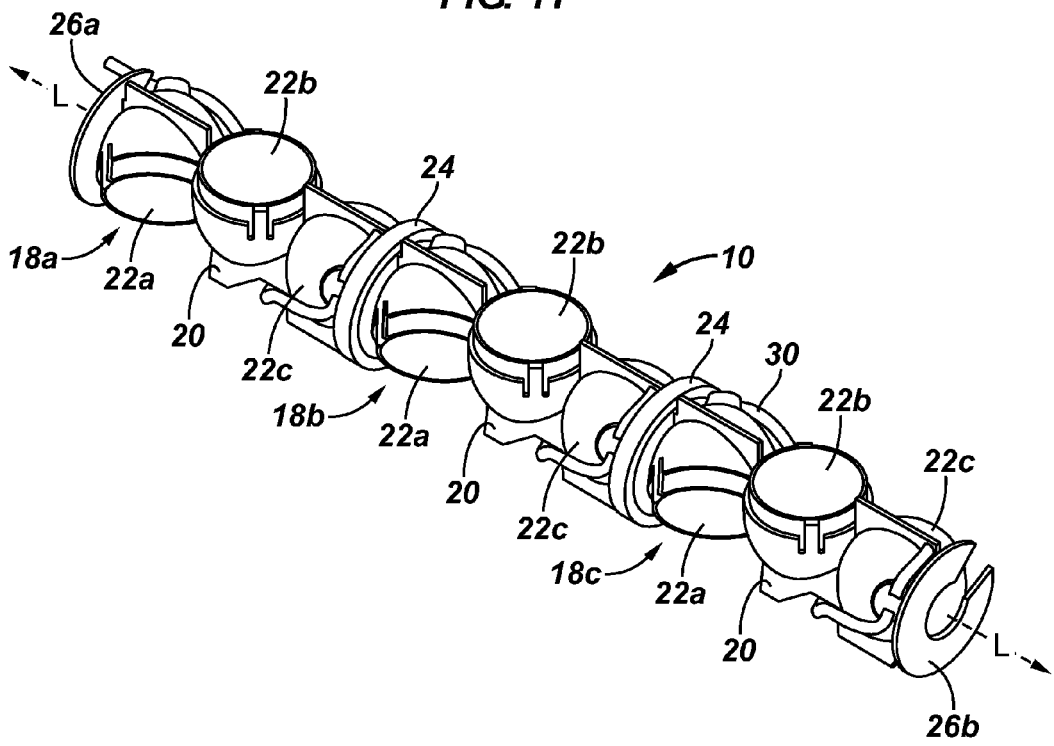
FIG. 11 is a rear perspective view of a wellbore perforating device.

FIG. 11 depicts another example of a perforating device or gun 10. In this example, each outer charge 22*a*, 22*c* is aziumuthally phased at a 120° angle with respect to the inner charge 22*b*.

In certain examples depicted, perforation is accomplished in an optimal manner that enhances creation of transverse fractures. Pressures required to break down fractures are reduced and connectivity between the created fracture and perforating holes in the well casing and pipe are increased. In many environments, natural bedding planes and extreme textures in for example gas shales require pinpoint perforation to properly initiate fractures. By orienting shaped charges in such a manner that upon detonation of the charges, the jets intersect a common plan extending transversely to the holder, such objectives can be met. The particular orientations about the azimuth and tilt angles can be manipulated depending upon the specific geography being fractured. In addition, different types of charges (e.g. deep penetration charges or big hole charges) can be used in combination to achieve predetermined fracturing criteria.

What is claimed is:

1. A wellbore perforating device comprising:

a holder extending in a longitudinal direction;

a plurality of shaped charges held by the holder and spaced apart in the longitudinal direction, the plurality of shaped charges comprising an inner charge disposed between a pair of outer charges, each shaped charge of the plurality of shaped charges forming a charge jet upon detonation;

each outer charge of the pair of outer charges tilted toward the inner charge in the longitudinal direction such that upon detonation the respective charge jets intersect a common plane extending transversely to the holder at a predetermined radial distance from the holder; and each outer charge of the pair of outer charges phased about the longitudinal direction at an azimuth angle that is greater than zero with respect to the inner charge such that upon detonation the respective charge jets do not intersect at a common point on the common plane.

2. A wellbore perforating device according to claim 1, wherein the inner charge is held by the holder at a perpendicular orientation to the longitudinal direction.

3. A wellbore perforating device according to claim 2, wherein upon detonation, the charge jet formed by the inner charge travels outwardly from the holder in a radial direction that is substantially perpendicular to the longitudinal direction and that extends along the common plane.

4. A wellbore perforating device according to claim 1, wherein each outer charge of the pair of outer charges is azimuthally phased within 15 degrees of the inner charge.

5. A wellbore perforating device according to claim 1, wherein each outer charge of the pair of outer charges is azimuthally phased within 30 degrees of the inner charge.

6. A wellbore perforating device according to claim 1, wherein each outer charge of the pair of outer charges is azimuthally phased within 120 degrees of the inner charge.

7. A wellbore perforating device according to claim 1, wherein the pair of outer charges are phased at an azimuth angle greater than zero with respect to each other.

* * * * *